US009351588B2

(12) United States Patent
Burns et al.

(10) Patent No.: US 9,351,588 B2
(45) Date of Patent: May 31, 2016

(54) CHILD SUPPORT UNIT FOR A PLAY YARD

(71) Applicant: KIDS II, INC., Atlanta, GA (US)

(72) Inventors: Stephen R. Burns, Cumming, GA (US); Chaitanya Tadipatri, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 3 days.

(21) Appl. No.: 14/088,985

(22) Filed: Nov. 25, 2013

(65) Prior Publication Data

US 2014/0359938 A1 Dec. 11, 2014
US 2016/0120335 A9 May 5, 2016

Related U.S. Application Data

(60) Provisional application No. 61/731,251, filed on Nov. 29, 2012, provisional application No. 61/827,051, filed on May 24, 2013, provisional application No. 61/831,862, filed on Jun. 6, 2013.

(51) Int. Cl.

| | |
|---|---|
| ***A47D 7/00*** | (2006.01) |
| ***A47D 13/06*** | (2006.01) |
| ***A47D 7/04*** | (2006.01) |

(52) U.S. Cl.
CPC ..... *A47D 13/063* (2013.01); *A47D 7/04* (2013.01)

(58) Field of Classification Search
CPC ..... A47D 7/00
USPC ..... 5/93.1, 98.1, 93.2, 99.1, 102
See application file for complete search history.

(56) References Cited

U.S. PATENT DOCUMENTS

| | | | |
|---|---|---|---|
| 1,288,347 | A | 12/1918 | Wilson |
| 1,391,650 | A | 9/1921 | Truesdell et al. |
| 1,427,598 | A | 8/1922 | Jackson |
| 1,493,505 | A | 5/1924 | Smith |
| 1,512,522 | A | 10/1924 | Colburn |
| 1,545,446 | A | 7/1925 | Paulet |
| 1,658,944 | A | 2/1928 | Schaeffer |
| 1,724,479 | A | 8/1929 | Havener |
| 1,794,561 | A | 3/1931 | Taylor |
| 1,812,971 | A | 7/1931 | McCandless |
| 1,827,687 | A | 10/1931 | McCandless |
| 2,280,913 | A | 4/1942 | Hummel et al. |
| 2,595,532 | A | 5/1952 | Leitner |
| 2,614,264 | A | 10/1952 | Schmidt, Jr. |
| 2,752,614 | A | 7/1956 | Hayward |
| 2,831,199 | A | 4/1958 | Stanley |
| 3,135,970 | A | 6/1964 | Trent et al. |
| 3,427,666 | A | 2/1969 | Saxe |
| 3,644,947 | A | 2/1972 | Padera |

(Continued)

FOREIGN PATENT DOCUMENTS

| | | | |
|---|---|---|---|
| DE | 2856168 | A1 | 7/1980 |
| DE | 8705939 | U1 | 9/1987 |

(Continued)

*Primary Examiner* — Fredrick Conley
(74) *Attorney, Agent, or Firm* — Gardner Groff Greenwald & Villanueva, PC

(57) ABSTRACT

A play yard system for infants or small children. They play yard includes a frame, and the system includes at least one child support unit for mounting to the frame of the play yard. The at least one child support unit may take the form of a bassinet and/or a changing table. The play yard frame may be collapsible for storage and transport, and the child support unit may be removable from the play yard frame.

6 Claims, 6 Drawing Sheets

(56) References Cited

U.S. PATENT DOCUMENTS

| | | | | |
|---|---|---|---|---|
| 4,967,432 | A | 11/1990 | Kujawski et al. | |
| 5,092,001 | A | 3/1992 | Ross et al. | |
| 5,163,191 | A | 11/1992 | Chan | |
| 5,339,470 | A | 8/1994 | Shamie | |
| 5,349,709 | A | 9/1994 | Cheng | |
| 5,446,934 | A | 9/1995 | Frazier | |
| 5,553,336 | A * | 9/1996 | Mariol | 5/93.1 |
| 5,697,111 | A | 12/1997 | Dillner et al. | |
| 5,778,465 | A | 7/1998 | Myers | |
| 5,819,342 | A | 10/1998 | Williams | |
| 5,826,285 | A | 10/1998 | Mariol et al. | |
| 5,845,349 | A | 12/1998 | Tharalson et al. | |
| 5,845,666 | A | 12/1998 | Messner | |
| 5,867,850 | A | 2/1999 | Mariol | |
| 5,867,851 | A | 2/1999 | Mariol et al. | |
| 5,918,329 | A | 7/1999 | Huang | |
| 5,991,944 | A | 11/1999 | Yang | |
| 6,058,528 | A | 5/2000 | Yang | |
| 6,182,308 | B1 | 2/2001 | Yang | |
| 6,192,535 | B1 | 2/2001 | Warner, Jr. et al. | |
| 6,418,575 | B1 | 7/2002 | Cheng | |
| 6,470,515 | B1 | 10/2002 | Hsia | |
| 6,526,608 | B1 | 3/2003 | Hsia | |
| 6,539,563 | B1 | 4/2003 | Hsia | |
| 6,543,070 | B2 | 4/2003 | Longenecker et al. | |
| 6,735,796 | B2 | 5/2004 | Warner, Jr. et al. | |
| 6,877,173 | B2 | 4/2005 | Tharalson et al. | |
| 6,948,197 | B1 | 9/2005 | Chen | |
| 6,952,849 | B2 | 10/2005 | Pacella | |
| 7,003,823 | B1 | 2/2006 | Reed et al. | |
| 7,111,339 | B2 | 9/2006 | Chen | |
| 7,228,575 | B2 | 6/2007 | Chen | |
| 7,263,729 | B2 * | 9/2007 | Paesang et al. | 5/98.1 |
| 7,346,943 | B2 | 3/2008 | Chen | |
| 7,376,993 | B2 | 5/2008 | Myers et al. | |
| 7,415,739 | B2 | 8/2008 | Tharalson et al. | |
| 7,418,745 | B2 | 9/2008 | Paesang et al. | |
| 7,458,114 | B2 | 12/2008 | Troutman | |
| 7,509,694 | B2 | 3/2009 | Chen | |
| 7,568,242 | B2 | 8/2009 | Troutman | |
| 7,581,269 | B2 | 9/2009 | Chen et al. | |
| 7,739,759 | B2 | 6/2010 | Mendes et al. | |
| 7,818,832 | B2 | 10/2010 | Hartenstine et al. | |
| 7,882,579 | B2 | 2/2011 | Jackson et al. | |
| 7,908,686 | B2 | 3/2011 | Clapper et al. | |
| 7,937,790 | B2 | 5/2011 | Zhao et al. | |
| 7,950,081 | B2 | 5/2011 | Chen et al. | |
| 7,958,578 | B2 | 6/2011 | Shan et al. | |
| 8,001,630 | B2 | 8/2011 | Burkholder et al. | |
| 8,011,036 | B2 | 9/2011 | Tuckey | |
| 8,028,358 | B2 | 10/2011 | Fiore, Jr. | |
| 8,141,186 | B2 | 3/2012 | Burns et al. | |
| 8,201,291 | B2 | 6/2012 | Burns et al. | |
| 8,230,536 | B2 | 7/2012 | Clapper et al. | |
| 8,257,229 | B2 | 9/2012 | Myers et al. | |
| 8,281,431 | B2 | 10/2012 | Hartenstine | |
| 8,291,530 | B2 | 10/2012 | Burkholder et al. | |
| 8,307,475 | B2 | 11/2012 | Hutchinson et al. | |
| 8,316,481 | B2 | 11/2012 | Arnold, IV et al. | |
| 8,316,483 | B2 | 11/2012 | Thomas et al. | |
| 8,321,973 | B2 | 12/2012 | Bickley | |
| 8,387,807 | B2 | 3/2013 | Chen et al. | |
| 8,424,131 | B2 | 4/2013 | Thomsen et al. | |
| 8,491,215 | B2 | 7/2013 | Young | |
| 8,522,374 | B2 | 9/2013 | Sousa et al. | |
| 8,528,130 | B2 | 9/2013 | Bu et al. | |
| 8,544,125 | B2 | 10/2013 | Greger et al. | |
| 8,555,434 | B2 | 10/2013 | Chapman et al. | |
| 8,566,988 | B2 | 10/2013 | Son et al. | |
| 8,677,533 | B2 | 3/2014 | Barron et al. | |
| 8,764,612 | B2 | 7/2014 | Myers et al. | |
| 8,806,673 | B2 | 8/2014 | Burkholder et al. | |
| 8,893,325 | B2 | 11/2014 | Arnold, IV et al. | |
| 8,925,128 | B2 | 1/2015 | Fiore, Jr. et al. | |
| 2001/0001330 | A1 | 5/2001 | Warner, Jr. et al. | |
| 2003/0177575 | A1 | 9/2003 | Cheng et al. | |
| 2005/0150053 | A1 | 7/2005 | Hartenstine | |
| 2006/0000019 | A1 | 1/2006 | Martin | |
| 2006/0021138 | A1 | 2/2006 | Waldman et al. | |
| 2006/0080776 | A1 | 4/2006 | Clapper et al. | |
| 2006/0218725 | A1 | 10/2006 | Carpenter et al. | |
| 2006/0225204 | A1 | 10/2006 | Bretschger et al. | |
| 2007/0017025 | A1 | 1/2007 | Myer | |
| 2007/0204403 | A1 | 9/2007 | Hartenstine | |
| 2007/0204404 | A1 | 9/2007 | Hartenstine | |
| 2007/0271697 | A1 | 11/2007 | Martin | |
| 2010/0138991 | A1 | 6/2010 | Hartenstine et al. | |
| 2010/0162484 | A1 | 7/2010 | Thomas et al. | |
| 2012/0037869 | A1 | 2/2012 | Fiore, III et al. | |
| 2013/0086750 | A1 | 4/2013 | Cheng | |
| 2013/0125304 | A1 | 5/2013 | DeHart et al. | |
| 2013/0198952 | A1 | 8/2013 | Rong et al. | |
| 2014/0068857 | A1 | 3/2014 | Jackson et al. | |
| 2014/0208503 | A1 | 7/2014 | Horst et al. | |
| 2014/0215713 | A1 | 8/2014 | Myers et al. | |

FOREIGN PATENT DOCUMENTS

| | | | |
|---|---|---|---|
| DE | 4327819 | A1 | 2/1994 |
| DE | 20000537 | U1 | 8/2000 |
| EP | 1147727 | A1 | 10/2001 |
| EP | 2359719 | A1 | 8/2011 |
| EP | 2710930 | A2 | 3/2014 |
| FR | 2593369 | A1 | 7/1987 |
| GB | 2330070 | A | 4/1999 |
| WO | 2013003320 | A2 | 1/2013 |

* cited by examiner

CHILD SUPPORT UNIT FOR A PLAY YARD

CROSS-REFERENCE TO RELATED APPLICATIONS

This application claims the benefit of U.S. Provisional Patent Application Ser. No. 61/731,251 filed Nov. 29, 2012, U.S. Provisional Patent Application Ser. No. 61/827,051 filed May 24, 2013 and U.S. Provisional Patent Application Ser. No. 61/831,862 filed Jun. 6, 2013, the entireties of which are hereby incorporated by reference herein.

TECHNICAL FIELD

The present invention relates generally to the field of child care accessories, and more particularly to a child support unit for a play yard and a play yard including such a child support unit.

BACKGROUND

Play yard devices are utilized to provide a safe and comfortable enclosure in which infants and small children can play and rest. It is to the provision of improvements to such devices that the present invention is primarily directed.

SUMMARY

In one example aspect, the present invention relates to a child support unit for a play yard. The play yard includes a frame, and the child support unit includes a subframe and at least one coupling for attachment of the child support unit to the frame of the play yard.

In another aspect, the invention relates to a system including a play yard and a child support unit. At least one coupling is provided between the child support unit and the play yard for mounting the child support unit to the play yard.

In still another aspect, the invention relates to a method of attachment of a child support unit to a play yard device, the method including coupling a subframe of the child support unit to the frame of the play yard.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
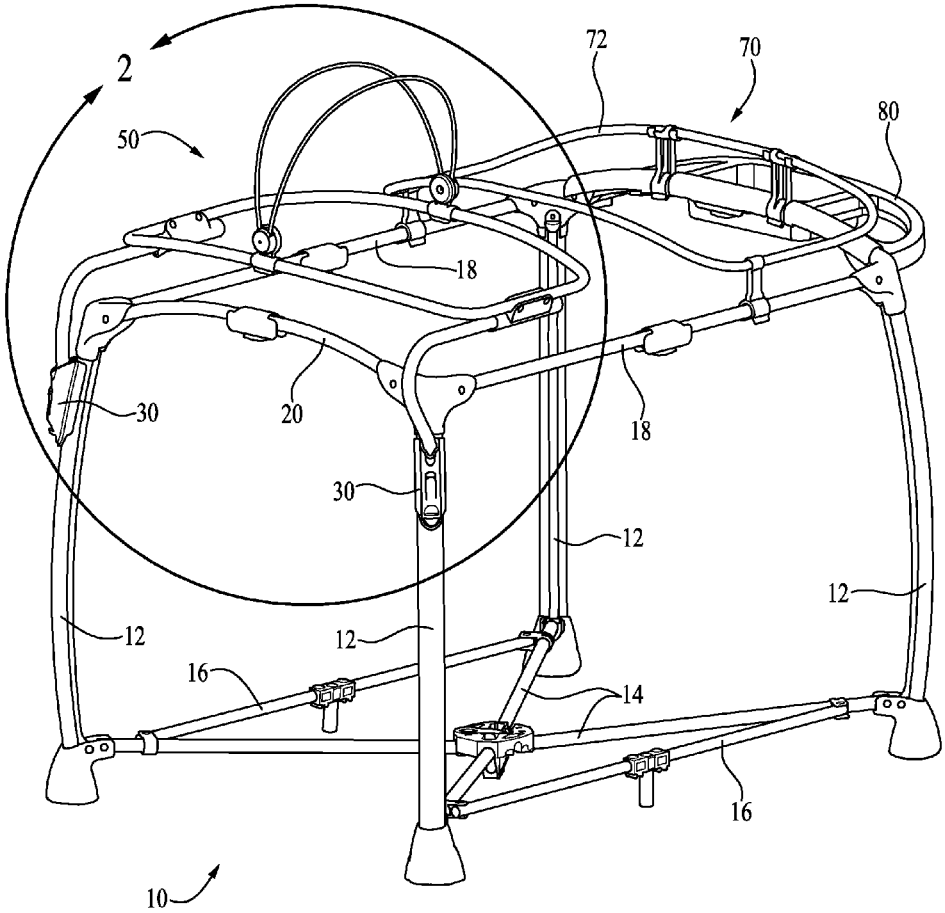
FIG. 1 is a perspective view of a play yard system having first and second child support units mounted thereto, according to an example embodiment of the present invention.
Figure 4:
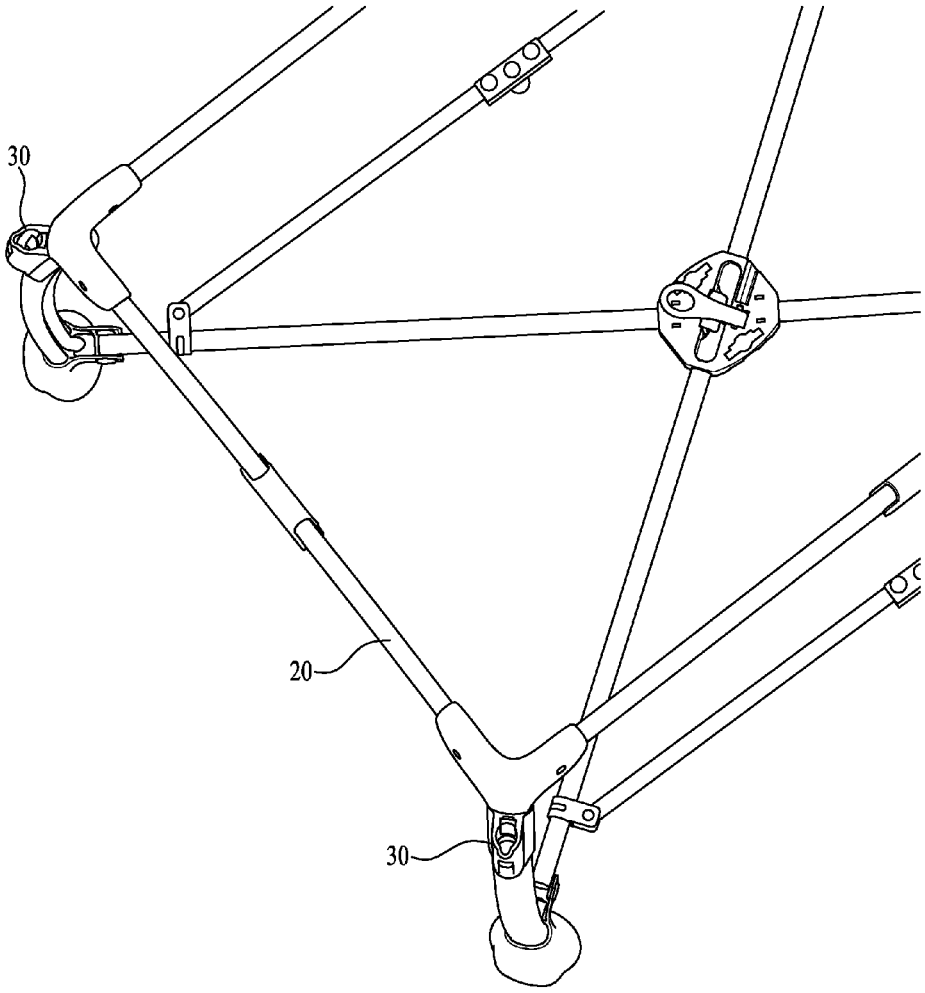
FIG. 4 is a top view showing mounting sleeves attached to the frame of the play yard device for receiving coupling members of the first child support unit to mount the child support unit to the play yard.
Figure 5:
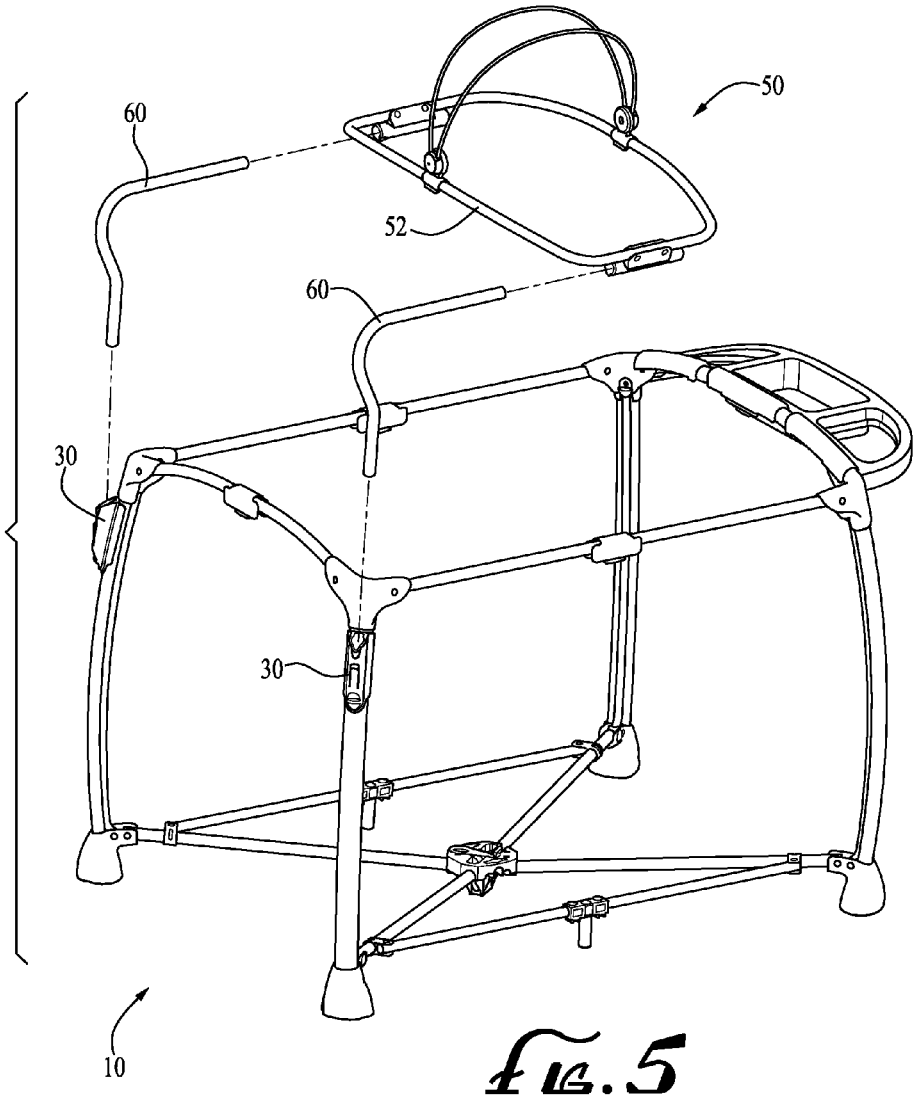
FIG. 5 is an assembly view of the play yard and the first child support unit.
Figure 6:
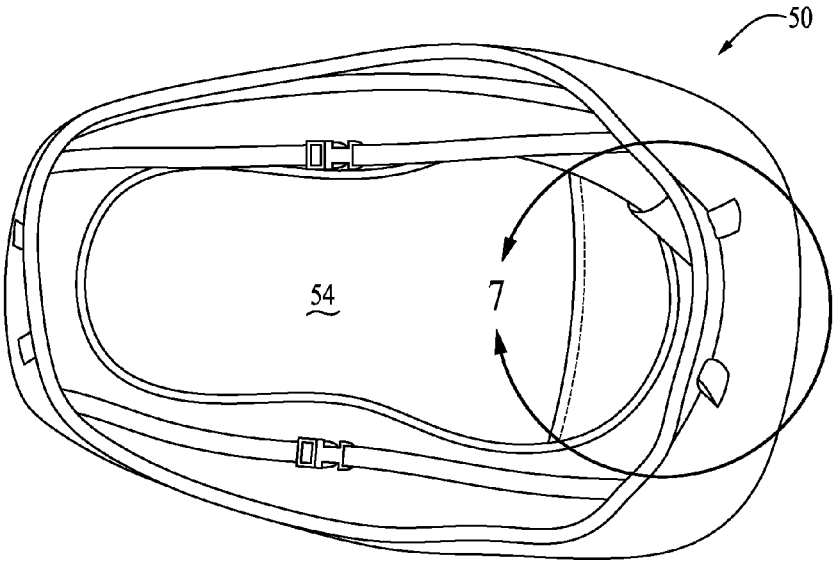
FIGS. 6-8 show further details of the child support unit, according to an example form of the invention.
Figure 7:
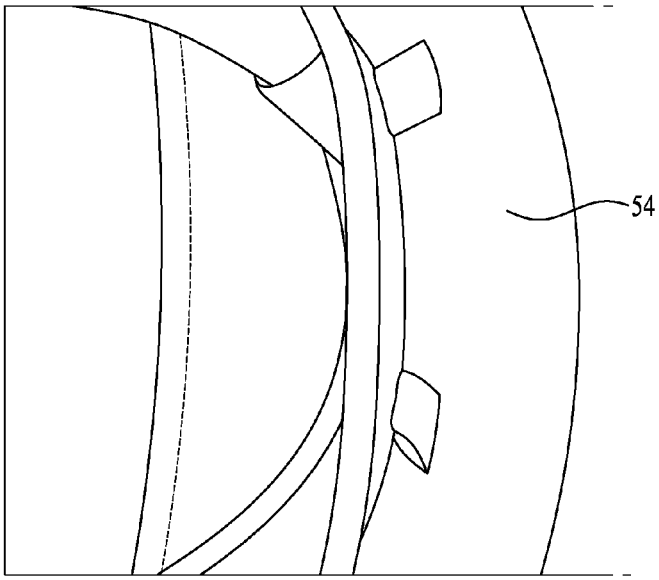

With reference now to the drawing figures, wherein like reference numbers represent corresponding parts throughout the several views, FIGS. 1, 4 and 5 show a play yard system 10 comprising a foldable frame having four corner posts 12, lower cross-bracing 14, lower siderails 16, upper siderails 18, and upper endrails 20. First and second mounting sleeves 30 are attached to the frame, for example along upper portions of the corner posts 12.

FIGS. 2, 3, and 6-8 show a first child support unit 50 configured for attachment to the frame of the play yard at a first location. In the depicted embodiment, the first child support unit 50 comprises a bassinet or cradle-like enclosure for receiving an infant or small child. The first child support unit 50 includes a subframe 52 comprising a generally rectangular periphery, soft-goods 54 such as fabric and padding installed onto the subframe forming a sling, bassinet or cradle for supporting a child placed in or on the support unit, and optionally a canopy 56 for covering at least a portion of the upper opening of the bassinet.

Figure 2:
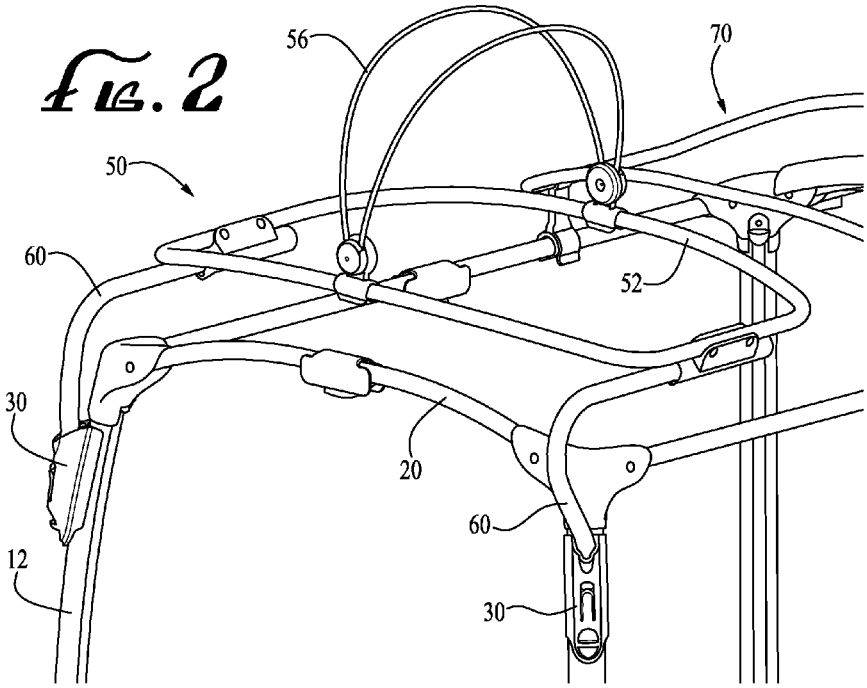
FIG. 2 is a perspective view showing greater detail of the support and mounting frame of the first child support unit.
Figure 3:
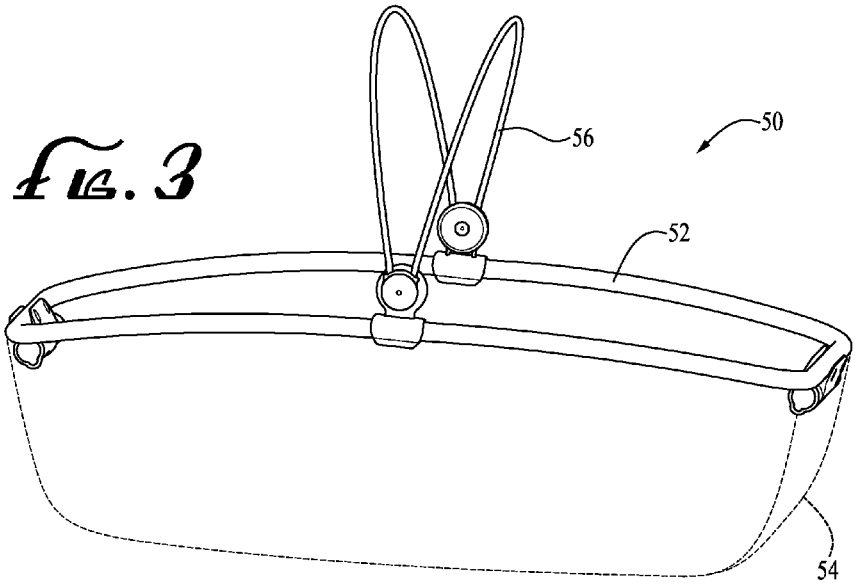
FIG. 3 is a perspective view of the first child support unit.
Figure 8:
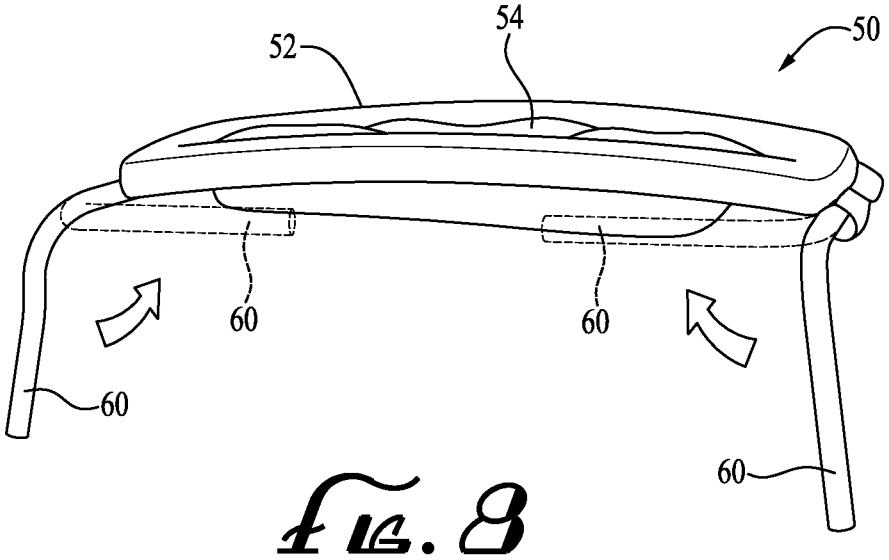

The first child support unit 50 is mounted to the play yard by at least one coupling, for example as shown in FIGS. 2 and 5. First and second mounting bars 60, each having a generally L-shaped configuration, have first ends for attachment to the frame of the play yard and second ends for attachment to the subframe of the first child support unit 50. For example, the first end of the mounting bar 60 is removably receivable within a corresponding mounting sleeve 30 attached to the frame of the play yard, and the second end of the mounting bar is receivable within a ferrule coupling attached to the subframe of the child support unit. As shown in FIG. 8, the mounting bars are optionally rotationally engaged within the ferrule couplings for compact storage when removed from the play yard frame. In alternate embodiments, various alternative coupling elements may be utilized for permanently or detachably mounting the child support unit to the play yard.

Optionally, the system 10 further comprises a second child support unit 70. For example, in the depicted embodiment, the second child support unit 70 comprises a changing table attachment having a generally rectangular subframe 72 to which a generally planar support panel may be mounted. One or more couplings 74 such as support struts with engagement clips secure the subframe of the second child support unit 70 to the frame of the play yard. One or more accessory trays or bins 80 are optionally mounted to the frame of the play yard, for holding toys, diapering supplies, a pacifier, or other items.

While the invention has been described with reference to preferred and example embodiments, it will be understood by those skilled in the art that a variety of modifications, additions and deletions are within the scope of the invention, as defined by the following claims.

What is claimed is:

1. A play yard system comprising a play yard frame having a plurality of vertical corner posts and a plurality of horizontal siderails, each vertical corner post having an upper end coupled to two of the horizontal siderails at an upper corner coupling of the play yard frame, the play yard system further comprising a first child support unit comprising a child support unit subframe separate from the play yard frame and a support surface mounted to the child support unit subframe for holding a child, and at least one child support unit coupling for mounting the child support unit subframe to the play yard frame, each child support unit coupling being attached to one of the plurality of vertical corner posts at a location below the upper corner coupling.

2. The play yard system of claim 1, wherein the at least one child support unit coupling comprises a mounting sleeve attached to the vertical corner post at the location below the upper corner coupling, and wherein the child support unit subframe comprises a mounting bar having an end removably engagable within the mounting sleeve.

3. The play yard system of claim 1, further comprising a second child support unit mounted to the play yard frame.

4. The play yard system of claim 1, wherein the first child support unit comprises a bassinet.

5. A child support unit for attachment to a play yard system, the play yard system having a play yard frame comprising a plurality of vertical frame legs and a plurality of horizontal siderails, each vertical frame leg having an upper end and a lower end, the upper end of each vertical frame leg being coupled to two of the horizontal siderails by an upper corner coupling, the child support unit comprising a child support unit subframe assembly and soft goods attached to the subframe assembly and defining a child support surface, wherein the child support unit is mounted to at least one child support unit coupling attached to a vertical frame leg between its upper end and its lower end.

6. A method of attachment of a child support unit to a play yard device, the play yard device comprising a play yard frame having a plurality of vertical corner posts and a plurality of horizontal siderails, the plurality of corner posts and the plurality of horizontal siderails being coupled together by upper corner frame connectors, the method comprising mounting a subframe of the child support unit to at least one child support unit coupling attached to at least one of the plurality of vertical corner posts of the play yard, the at least one child support unit coupling being positioned below at least one of the upper corner frame connectors.

* * * * *